US005887833A

United States Patent [19]

Sundara et al.

[11] Patent Number: 5,887,833

[45] Date of Patent: Mar. 30, 1999

[54] LOW PROFILE GOLF BAG STAND SYSTEM

[75] Inventors: Chloe Helen Sundara, Mill Valley; Eric Penman Bogner, San Francisco; Bruce Anthony Janis; Bruce Stephen Levin, both of San Francisco; Colin Kennedy, Mill Valley, all of Calif.

[73] Assignee: Sundara Industries, Ltd., San Francisco, Calif.

[21] Appl. No.: 925,243

[22] Filed: Sep. 8, 1997

[51] Int. Cl.[6] ..... A63B 55/00

[52] U.S. Cl. ..... 248/96; 206/315.7

[58] Field of Search ..... 242/96, 92, 688, 242/689, 146, 164; 206/315.7, 315.3; 248/96

[56] References Cited

U.S. PATENT DOCUMENTS

| | | | |
|---|---|---|---|
| Re. 35,684 | 12/1997 | Maeng | 248/96 |
| 2,236,053 | 3/1941 | Caron . | |
| 2,324,439 | 7/1943 | Thommen | 248/96 |
| 2,572,408 | 10/1951 | Vanden Hoek | 280/36 |
| 2,663,528 | 12/1953 | Hadley | 248/96 |
| 2,784,005 | 3/1957 | Abgarian . | |
| 4,302,029 | 11/1981 | Albertson | 280/646 |
| 4,681,341 | 7/1987 | Lai | 280/646 |
| 4,921,192 | 5/1990 | Jones | 248/96 |
| 5,036,974 | 8/1991 | Ross, Jr. | 206/315.7 |
| 5,074,576 | 12/1991 | Finlay | 280/645 |
| 5,147,089 | 9/1992 | Anderson | 248/96 |
| 5,209,350 | 5/1993 | Maeng | 206/315.7 |
| 5,236,085 | 8/1993 | Quellais | 206/315.7 |
| 5,339,951 | 8/1994 | Chen | 206/315.7 |
| 5,340,063 | 8/1994 | Hsieh | 248/96 |
| 5,351,921 | 10/1994 | Chen | 248/96 |
| 5,407,155 | 4/1995 | Chung | 248/96 |
| 5,464,180 | 11/1995 | Cheng | 248/96 |
| 5,507,384 | 4/1996 | Maeng | 206/315.7 |
| 5,516,064 | 5/1996 | Hsieh | 248/96 |
| 5,597,144 | 1/1997 | Lee | 248/96 |
| 5,634,616 | 6/1997 | Wang et al. | 248/96 |
| 5,662,296 | 9/1997 | Wu | 248/96 |
| 5,673,879 | 10/1997 | Hsieh | 248/96 |
| 5,681,016 | 10/1997 | Wang | 248/96 |
| 5,762,189 | 6/1998 | Reimers | 206/315.7 |

FOREIGN PATENT DOCUMENTS

| | | |
|---|---|---|
| 1200909 | of 0000 | France . |
| 483754 | of 0000 | United Kingdom . |
| 618996 | of 0000 | United Kingdom . |
| 2 278 290 | 8/1993 | United Kingdom . |

*Primary Examiner*—Leslie A. Braun
*Assistant Examiner*—Tan Le
*Attorney, Agent, or Firm*—Blakely, Sokoloff, Taylor & Zafman

[57] ABSTRACT

A new ultra light weight, spring action, stand system for supporting a golf bag is provided. According to one aspect of the present invention, the stand system includes a top bracket, a pair of legs, a guide, a wire form, and a footplate. The top bracket is configured for coupling to a top portion of a golf bag. The pair of legs may be pivotably coupled to the top bracket. The guide is for coupling to a bottom portion of the golf bag to restrain lateral movement of the wire form, for example. The wire form is slidably coupled through the guide and engages the legs. The actuation of the wire form moves the legs from a retracted position to an extended position. Finally, the footplate is pivotably mounted to the wire form and is positioned to have a contact point with the ground for actuating the wire form that is behind the plane of the legs. According to other aspects of the present invention, the stand system includes one or more of the following: a bi-planar cut away base to facilitate engagement of the spring mechanism, a double clip and crimped wire form to hold the clip in place at a very high tension, oversized feet to provide increased stability and usability in soft soil conditions, a compact retracted leg arrangement that will not poke or prod the golfer as he/she carries the bag, and a novel femur design that prevents the unsightly occurrence of crossed legs.

12 Claims, 6 Drawing Sheets

LOW PROFILE GOLF BAG STAND SYSTEM

FIELD OF THE INVENTION

The invention relates generally to golf equipment. More particularly, the invention relates to spring action golf bag stands.

BACKGROUND OF THE INVENTION

Golf bag stands have been in existence for many years. However, no one stand mechanism has yet been designed to overcome the many limitations seen in the prior art. Many of the stands used in the past employ heavy weight mechanisms. Carrying heavy equipment, fatigues the golfer during play and tends to reduce the overall enjoyment of the golfing experience. The bulky stand hardware of other mechanisms poke the golfer or caddy while the bag is being carried. Other less bulky, prior art stand mechanisms while eliminating the poking and prodding during carrying of the bag are fragile, thus making these stands vulnerable to damage when attached to the back of a golf cart or when stowed in the trunk of a car, for example. For mounting the movable parts of some prior mechanisms the body fabric of the golf bags have to be pierced to attach the legs. Still other stand mechanisms require manual activation to engage and/or disengage the legs of the stand. Another common problem with prior art stands is the feet and stand actuation mechanism tend to sink in soft soil or mud.

In light of the foregoing it is desirable to provide an improved, automatic, light weight, spring action golf stand. Particularly, it is desirable that the stand mechanism have a compact design that keeps the stand integrated with the golf bag body and out of the way while the mechanism is retracted. Further, it is advantageous to provide a narrow profile width so the legs and other stand hardware do not hit the golfer or caddy while the bag is being carried. These and other advantages and features are provided by the improved stand system described herein.

SUMMARY OF THE INVENTION

A new ultra light weight, spring action, stand system for supporting a golf bag is described. According to one aspect of the present invention, the stand system includes a top bracket, a pair of legs, a guide, a wire form, and a footplate. The top bracket is configured for coupling to a top portion of a golf bag. The pair of legs may be pivotably coupled to the top bracket. The guide is for coupling to a bottom portion of the golf bag to restrain lateral movement of the wire form, for example. The wire form is slidably coupled through the guide and engages the legs. The actuation of the wire form moves the legs from a retracted position to an extended position. Finally, the footplate is pivotably mounted to the wire form and is positioned to have a contact point with the ground for actuating the wire form that is behind the plane of the legs. Advantageously, in this manner, the footplate is not exposed and is thus protected from being caught on external objects.

According to another aspect of the present invention, the stand system includes a double clip with tensioning at the top and separating at the bottom and the wire form includes crimps to hold the double clip in place at a very high tension. Thus, more spring back in the legs is provided.

According to yet another aspect of the present invention, the stand system includes a bi-planar cut away base that facilitates engagement of the wire form.

Other advantages and features of the present invention will be apparent from the accompanying drawings and from the detailed description which follows.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

A new ultra light weight, spring action, stand system for supporting a golf bag is described. In the following description, for the purposes of explanation, specific details are set forth in order to provide a thorough understanding of the present invention. It will be apparent, however, to one skilled in the art that the present invention may be practiced without some of these specific details.

EXEMPLARY STAND MECHANISM

Figure 1:
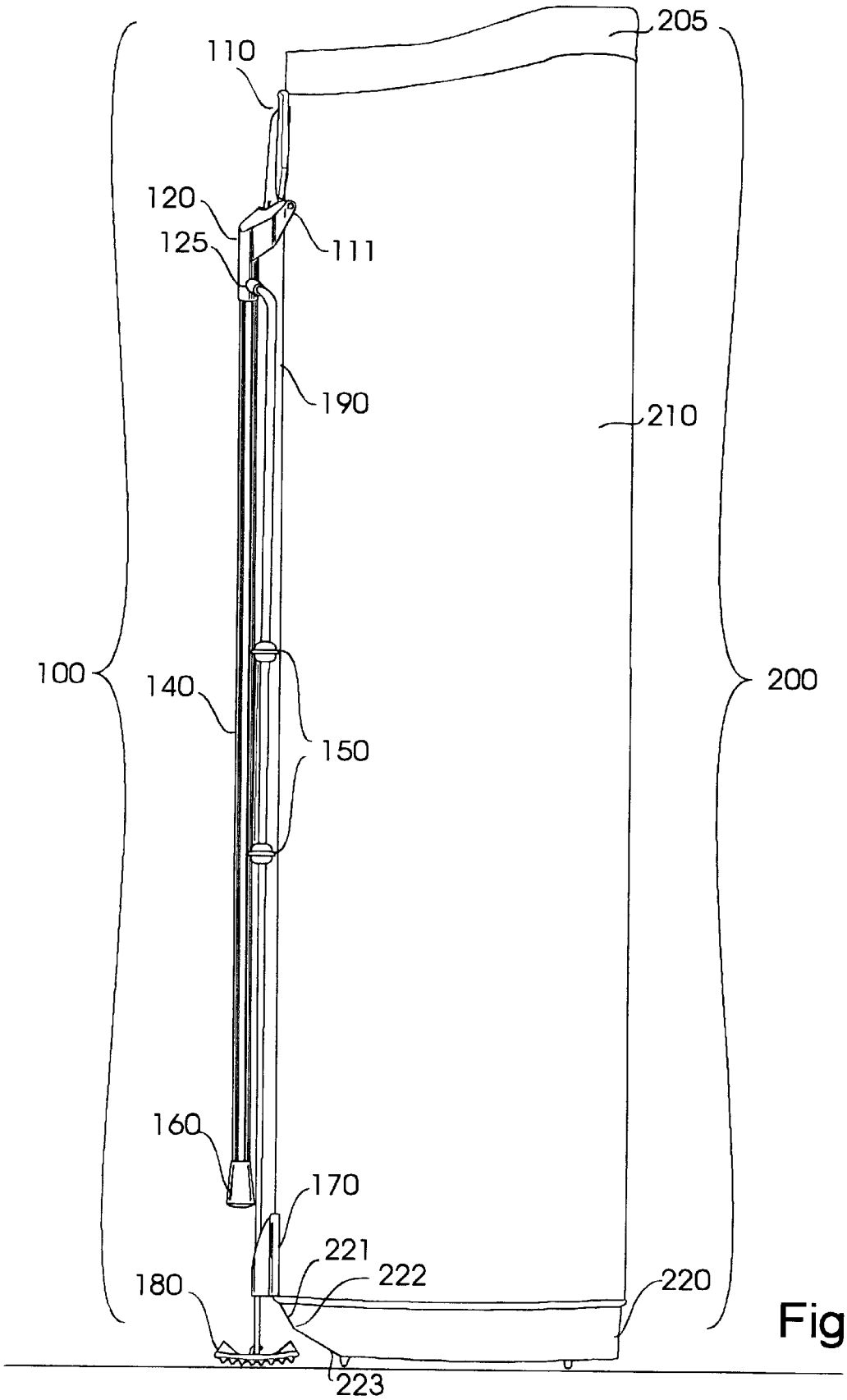
FIG. 1 is a side elevational view of a stand with its legs in the retracted position according to one embodiment of the present invention.
Figure 2:
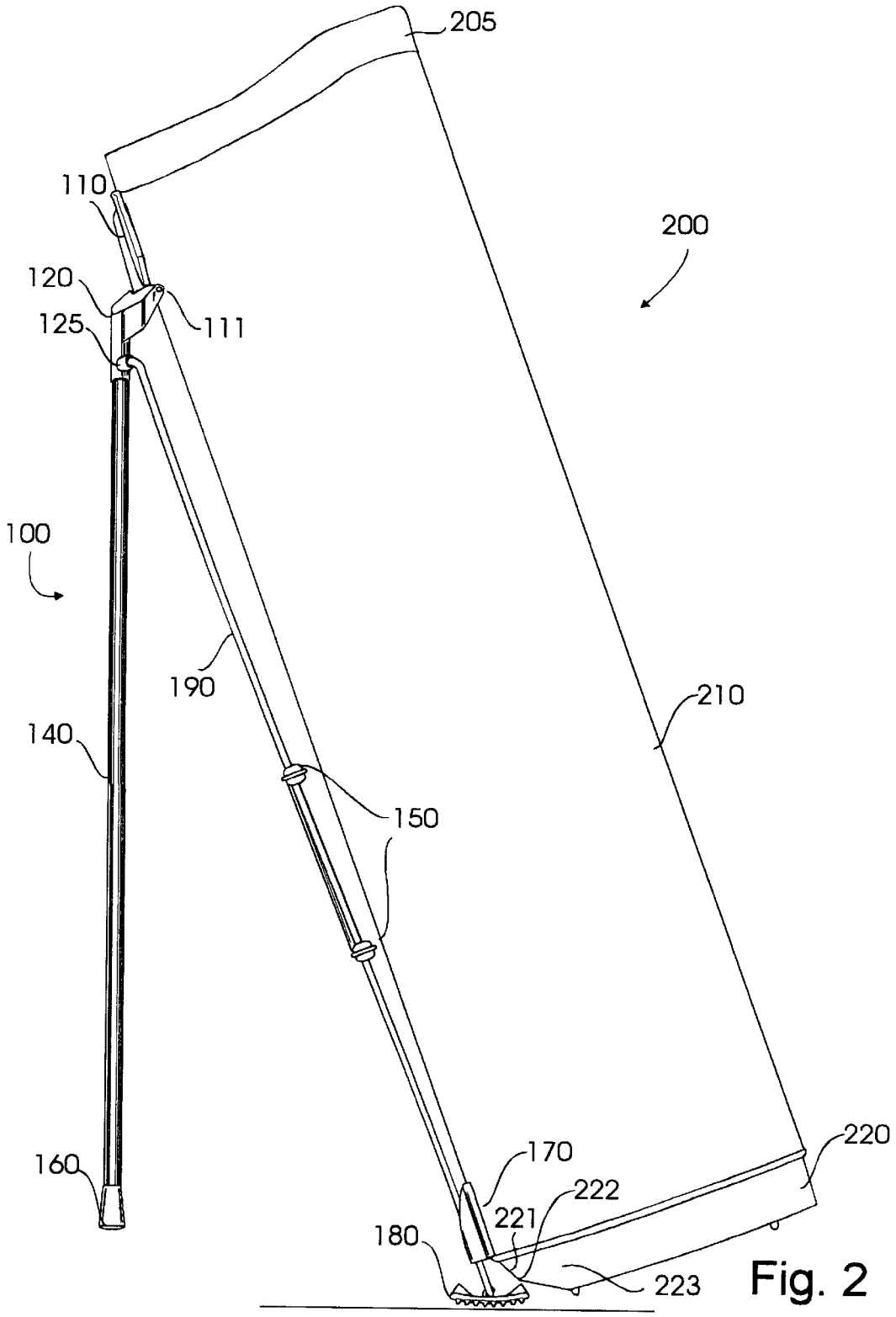
FIG. 2 is a side elevational view of the stand of FIG. 1 with its legs in an intermediate position.
Figure 3:
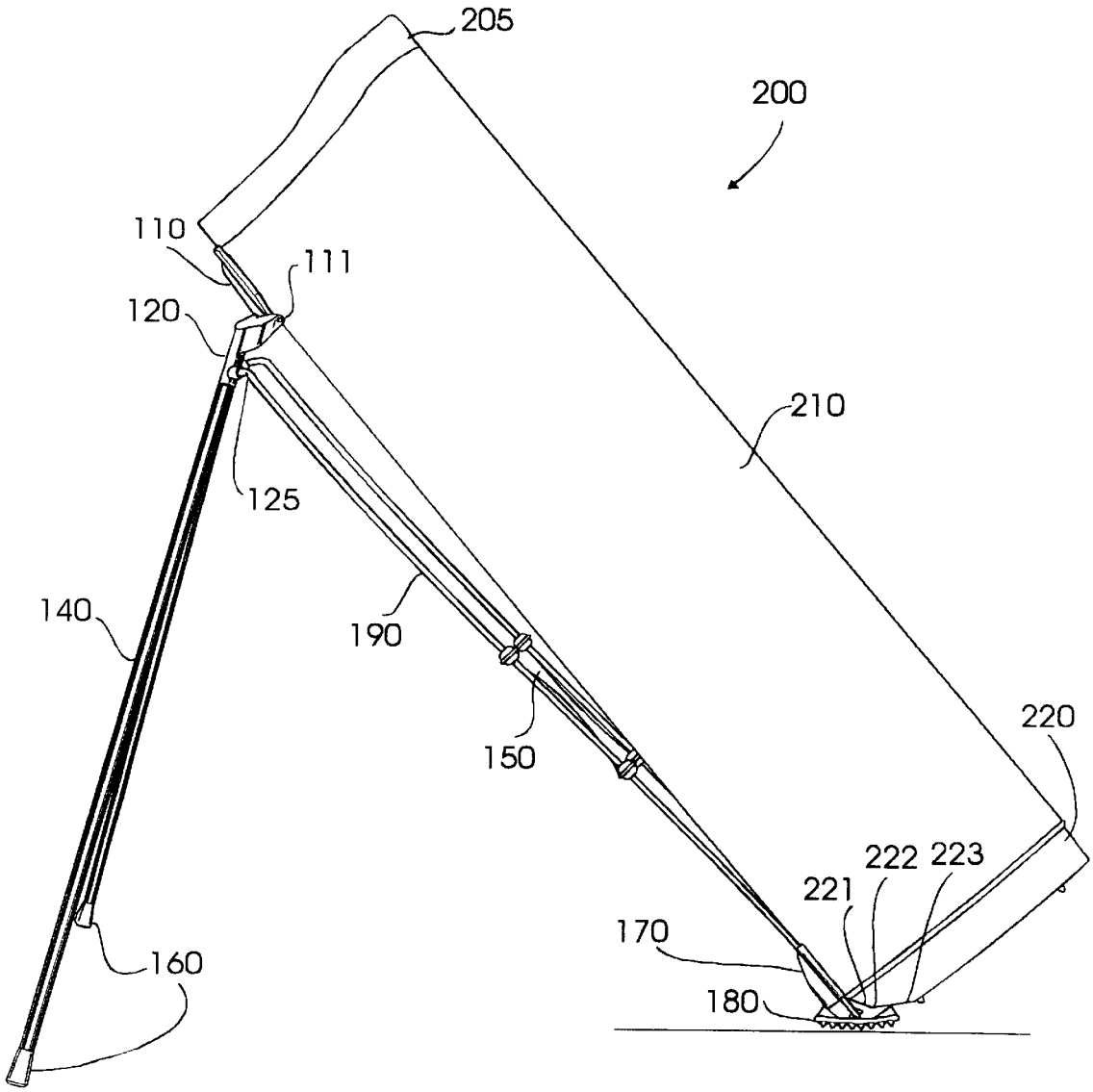
FIG. 3 is a side elevational view of the stand of FIG. 1 with its legs in the extended position.
Figure 4:
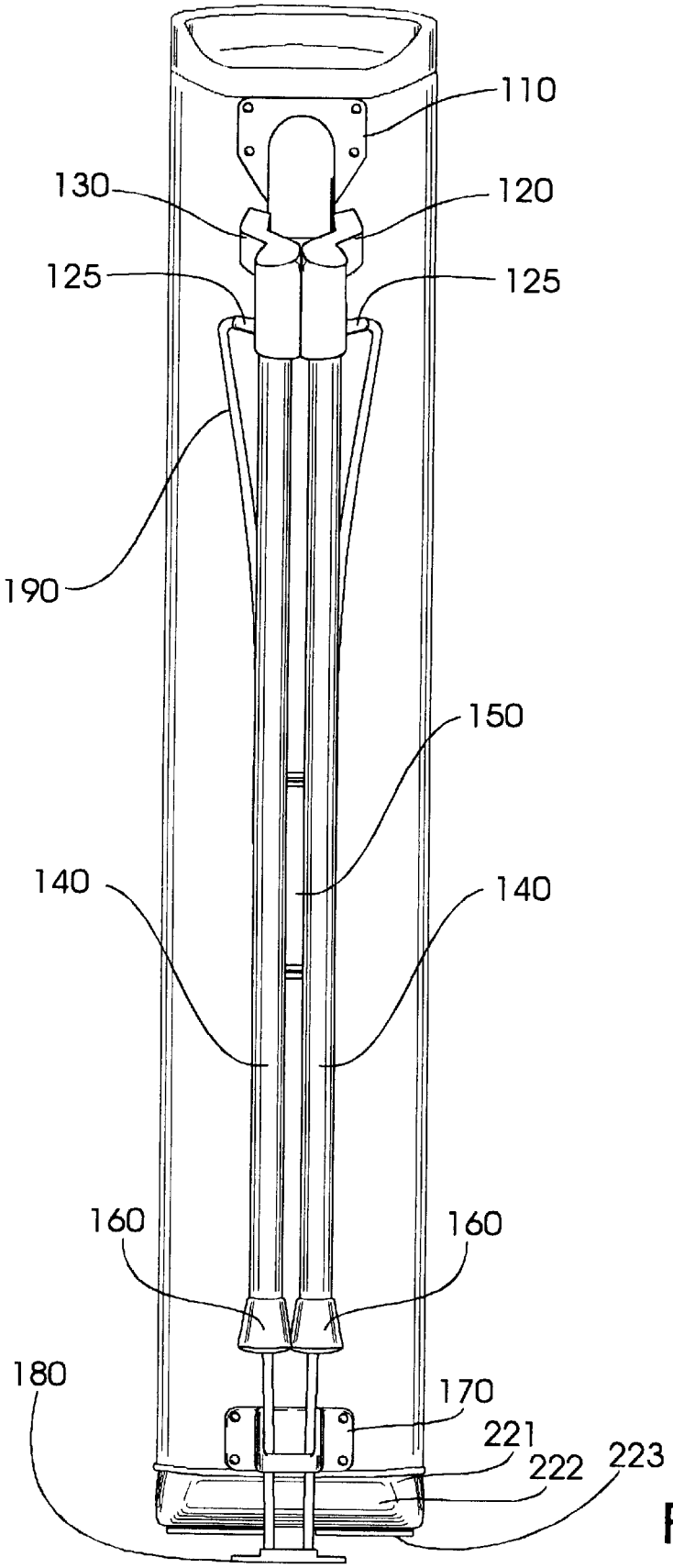
FIG. 4 is a front view of the stand of FIG. 1 with its legs in the retracted position.
Figure 5:
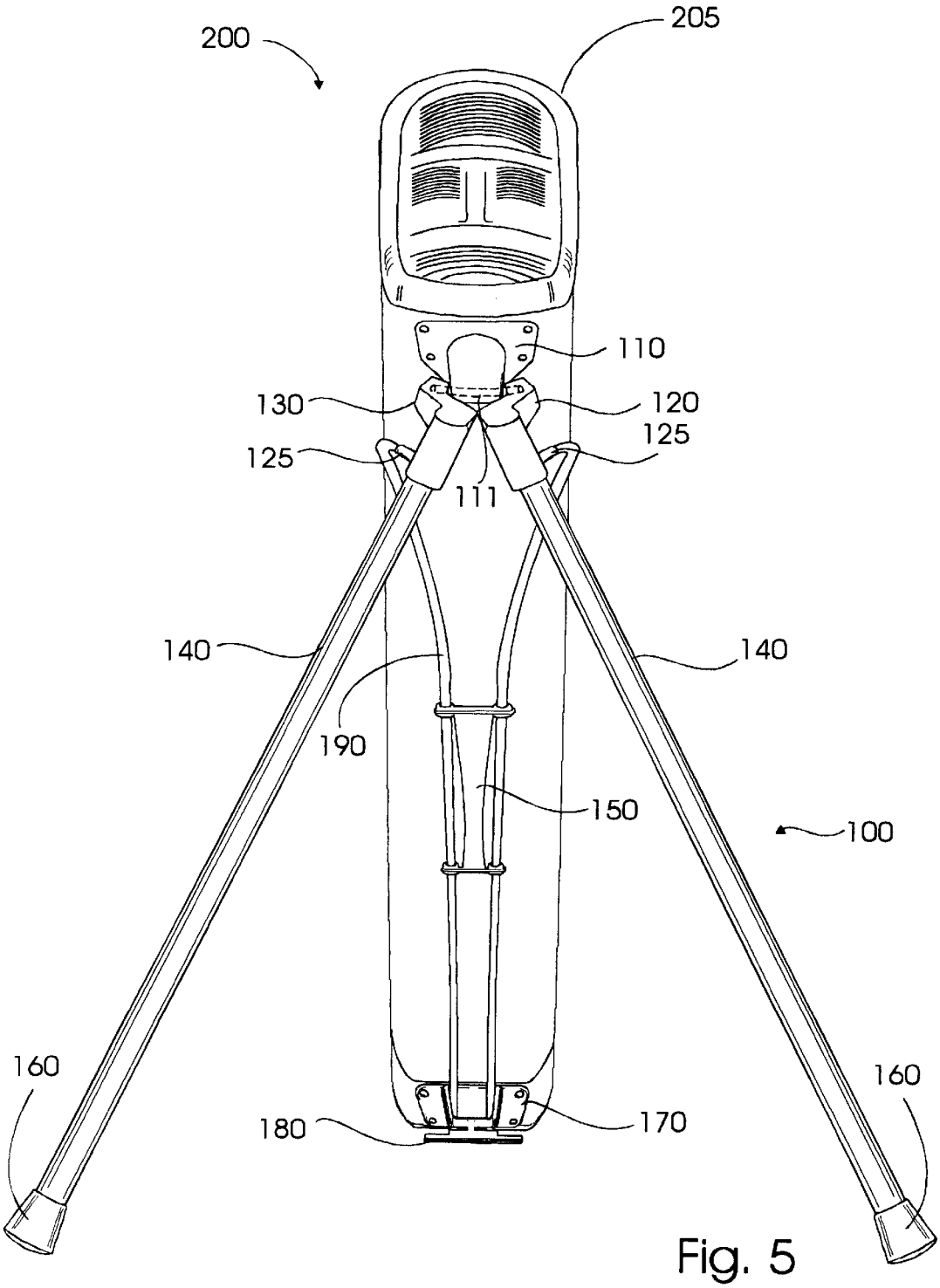
FIG. 5 is a front view of the stand of FIG. 1 with its legs in the extended position.

Referring to the figures, the stand 100 depicted comprises a top bracket 110, a pair of femurs 120 and 130, a wire form 190, a clip 150, a pair of legs 140, a pair of feet 160, a guide 170, and a footplate 180. FIGS. 1, 2, and 3 depict the stand 100 in three positions (1) a retracted position, (2) an intermediate position, and (3) an extended position. While a golf bag 200 to which the stand 100 is attached is in an upright vertical position or being carried, for example, the legs 140 of the stand 100 remain in their retracted (inoperative) state as illustrated by FIG. 1. However, when the golf bag 200 is set down, during club selection and/or club replacement, for example, and the footplate 180 is actuated by the weight of the golf bag 200, the legs 140 are shifted into their extended (operative) position as illustrated by FIG. 2. As the legs 140 move from their retracted position to their extended position, and vice versa, they pass through the intermediate position shown in FIG. 3. Having described the two positions in which the stand 100 will normally be during use, the stand's components and their interaction will now be discussed.

The top bracket 110 is configured for coupling to a top portion of the golf bag 200. For example, rivets may be used to secure the top bracket 110 to the top cuff of the golf bag 200 immediately below the top 205. According to the present embodiment, the mounting position of the top bracket 110 is such that the footplate 180 contacts the ground while the golf bag 200 is in its upright vertical position. Securely mounting the top bracket 110 at the upper most portion of the golf bag 200 provides for maximum tripod stability when the stand 100 is engaged.

The top bracket 110 may include a pivot mechanism such as an axle 111 about which the legs 140 may be pivoted to move between the retracted position and the extended position. The axle 111 may be a separate component that slides though a channel in the top bracket 110 or, alternatively, the axle 111 may simply be extrusions that are integral to the top bracket 110. It will be apparent to those of ordinary skill in the art that numerous other pivot mechanisms are available. For example, the axle 111 may comprise two separate pins. Additionally, the pins may be included within the legs 140 rather than being part of the top bracket 110. In this case, the top bracket 110, rather than the femurs 120 and 130 or the legs 140, would include a socket or the like for receiving the pins.

In the retracted position, the legs 140 are substantially adjacent to the golf bag and parallel to each other. Advantageously, the compact, low profile stand design of the present invention allows a golf bag 200 to which the stand 100 is attached to be carried without the caddy or golfer being poked by protruding stand hardware as is commonly experienced with bulky prior art stand designs. Another advantage of the new design is the fact that the stand hardware is less likely to become entangled with the golf bag 200 itself and other objects. For example, due to their nearness with each other and the fact that the legs 140 are not exposed beyond the width of the golf bag 200, the legs 140 are less likely to be snagged during use or storage. Moreover, in one embodiment, the substantially flat inner surface of the femurs 120 and 130 and the fact that the inner surfaces of the femurs 120 and 130 are the first contact point when the legs 140 retract prevents the legs 140 from becoming crossed. While the stand 100 of the present invention is already very light (approx. 1.25 lbs.), for optimal carrying comfort, the stand 100 may be mounted on a narrow profile, light weight golf bag designed and manufactured by Sundara Industries, Ltd., the assignee of the present invention.

In the extended position, the legs 140 are spaced apart from the golf bag 200 and oriented at an angle to each other thereby forming a tripod in connection with the golf bag 200 to support the golf bag 200 at a predetermined angle relative to the vertical. Preferably, the predetermined angle is such that the golf bag 200 is stable and clubs can be conveniently removed and replaced from the golf bag 200.

According to one embodiment, the legs 140 are a rigid, light weight material such as aluminum to keep the overall weight of the stand 100 to a minimum. The ends of the legs 140 are enclosed with oversized feet 160. The oversized feet 160 provide more surface area contact with the ground for increased stability and also help to prevent the stand 100 from sinking when it is engaged in soft soil or mud.

The legs 140 may be coupled to the pivot mechanism (e.g., the axle 111) by way of a pair of femurs 120 and 130. The femurs 120 and 130 each include a socket 125 for receiving an upper end of a spring mechanism such as the U-shaped wire form 190. As will be appreciated by those of ordinary skill in the art, alternative ways of rotatably coupling the spring mechanism and the femurs 120 and 130 are available. In any event, actuation of the spring mechanism moves the legs 140 from the retracted position to the extended position. That is, sliding the wire form 190 upward along the longitudinal axis of the golf bag 200 pushes the legs 140 away from the golf bag 200 and away from each other. The legs 140 will remain in the extended position as long as pressure is applied to the wire form 190. This pressure is typically provided by the weight of the golf bag 200 and accompanying clubs being tilted onto the footplate 180. Thus, the legs 140 automatically retract when the weight of the golf bag 200 is removed by lifting the golf bag 200 off of the ground.

Coupled to the wire form 190, at a position between the bottom of the golf bag 200 and the connection with the legs 140 is a tensioning mechanism such as the clip 150. The clip 150 holds the legs 140 in tension and encourages the legs 140 to retract when pressure is removed from the wire form 190 actuating mechanism. In addition to the tension provided by the clip 150, the inventors have found this tensioning mechanism to be more aesthetically pleasing than webbing or other retaining materials required to brace the legs of prior stands because these retaining materials tend to be loose and sloppy when the stand is in its retracted position. The novel clip 150 and its interaction with the wire form 190 will be discussed further below.

Also coupled to the wire form 190, at the bottom of the U portion of the wire form 190, is the footplate 180. The surface area provided by the footplate 180 keeps the wire form 190 from sinking into soft soil or mud, for example. As described above, pressure on the footplate 180 actuates the wire form 190 thereby extending the legs 140. During engagement of the stand 100, the footplate 180 swivels (on a pivotable coupling between the wire form 190 and the footplate 180, for example) to stay parallel to the ground. Importantly, in this manner, the footplate 180 remains engaged as the angle of the bag changes. The footplate 180 may be one piece or formed by coupling two or more component parts together with rivets, screws or like fastening mechanisms. It is appreciated that the footplate's size and shape may vary.

According to the present embodiment, the footplate 180 comes in contact with the ground at a point that is behind the longitudinal plane of the legs 140. Advantageously, this location of the footplate 180 shelters the part and prevents it from being broken off as a result of catching on carts, the trunk of a car, or other objects as commonly occurs with exposed footplates.

In the embodiment depicted, the stand 100 also includes a bottom bracket 170 for guiding movement of the wire form 190 along the longitudinal axis of the golf bag 200. As should be appreciated, the bottom bracket 170 may be coupled to a lower portion of the golf bag 200, and preferably is mounted immediately above the highest point of the base 220. In this manner, the bottom bracket 170 prevents unwanted lateral movement of the wire form 190 while allowing longitudinal movement of the wire form 190. In alternative embodiments, the bottom bracket 170 may be in the form of two individual hooks, webbing, or any other material encasement that restrains the wire form 190 to movement along the longitudinal axis of the golf bag 200.

As should be appreciated, the simplified connection of stand parts and the reduced number of connection points to the golf bag 200 facilitates easy replacement of parts, if necessary, and reduces the cost of assembly. Additional cost savings may be achieved in reduced freight costs due to the fact that golf bags including the novel stand can be collapsed and shipped flat. Moreover, the legs 140 and the wire form 190 may easily be removed by the golfer to use the golf bag 200 as a carry bag without the stand 100.

EXEMPLARY CUT AWAY BASE DESIGN

For easier engagement, the stand 100 of the present invention may be used in connection with a multi-faceted cut away base such as base 220. According to the embodiment depicted, the bi-planar cut away portion of the base 220 comprises two intersecting planes 221 and 223 connected by a radius 222. The cut away portion of the base 220 contributes to the overall compactness of the combination of the stand 100 and golf bag 200 by allowing the stand 100 to be located close to the longitudinal plane of the golf bag 200 and allowing it to remain so even while engaged. Additionally, the cut away portion of the base 220 facilitates actuation of the stand 100. The golfer or caddy may simply rock the golf bag 200 in the direction of the cut away portion of the base 220 to cause the legs 140 to extend. Finally, the cut away portion of the base 220 is advantageous because it increases the throw of the legs 140.

EXEMPLARY TENSIONING MECHANISM

Figure 6:
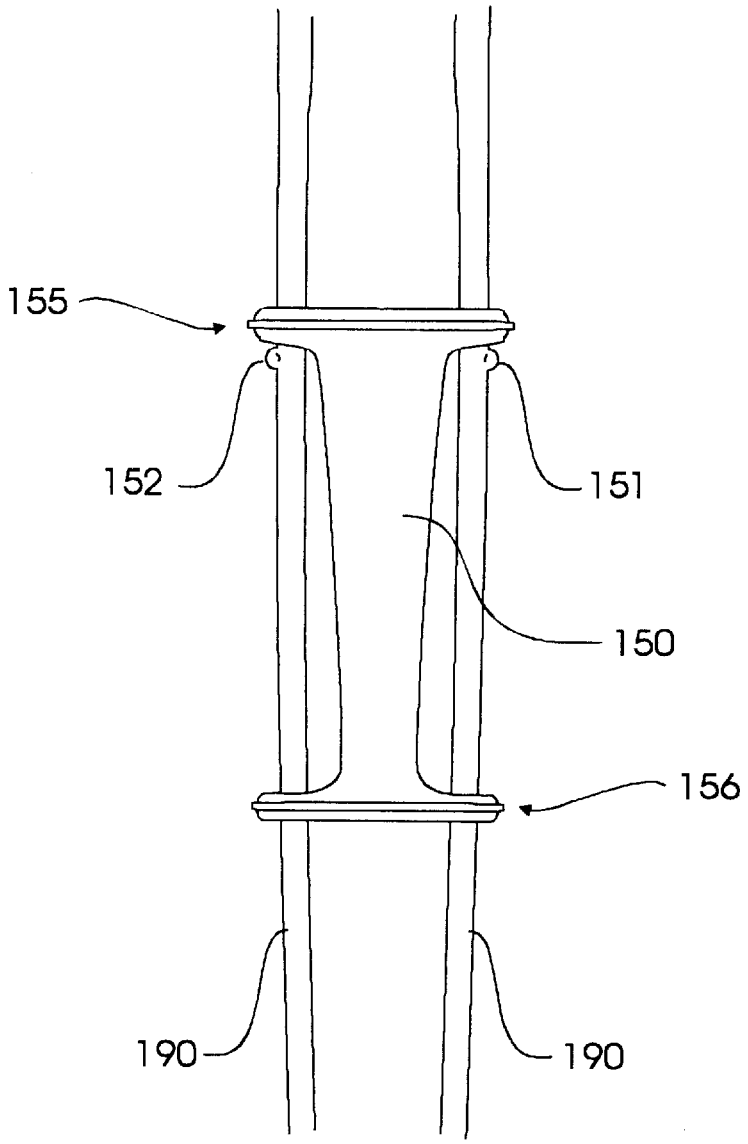
FIG. 6 illustrates a tensioning mechanism according to one embodiment of the present invention.

FIG. 6 illustrates a tensioning mechanism according to one embodiment of the present invention. According to the embodiment depicted, the double clip 150 is coupled between the two upright portions of the wire form 190 and provide tension to pull the legs 140 together and into the retracted position when the wire form 190 is disengaged. The double clip 150 includes a top end 155 and a bottom end 156. In one embodiment, the top end 155 provides tensioning in the wire form 190 and the bottom end 156 provides separation in the wire form 190. In this example, the tensioning at one end and the separation at the other keeps the double clip 150 from slipping as the legs 140 are extended.

According to another embodiment, deformities 151 and 152 in the wire form 190 keep the double clip 150 from slipping downward when the wire form 190 experiences increased tension while the legs 140 move from the retracted position to the extended position. The deformities 151 and 152 in the wire form 190 may be produced by a well known crimping process, for example, whereby the wire form 190 is flattened and thereby widened at two corresponding points 151 and 152 along the upright portions of the U-shaped wire form 190. Alternative approaches to deforming the wire form 190 will be apparent to those of ordinary skill in the art. In any event, the crimped portions 151 and 152 of the wire form 190 may be located immediately below the top end of the double clip 150 or immediately below the bottom end of the double clip 150. In this manner, the double clip 150 holds the wire form 190 in place at a very high tension without slipping. The increased tension produced by the combination of the crimps 151 and 152 in the wire form 190 and the double clip 150 provides more spring back in the legs 140 when the footplate 180 is disengaged. Additionally, the double clip 150 keeps the legs 140 securely in their retracted position until the footplate 180 is engaged.

ALTERNATIVE EMBODIMENTS

Many alternative embodiments are contemplated by the inventors of the present invention. For example, the wire form 190 may be attached to the femurs 120 and 130 with non-removable couplings rather than the sockets 125 depicted. Additionally, in other embodiments, the wire form 190 may comprise multiple pieces and have different shapes than depicted, such as a "Y" shape.

Also, the tensioning mechanism may be constructed of multiple pieces and be of various non-rigid and rigid material such as fabric, webbing, wire, and the like. Alternatively, intermediate bracket(s) could serve the function of the clip 150. For example, one or more additional guide brackets similar to bottom bracket 170 may be placed along the length of the wire form 190 and attached to the golf bag 200 to provide tension for urging the legs 140 together.

Additionally, it should be apparent that the legs may have different cross sections than illustrated, such as round or square cross sections.

Finally, while in the embodiment illustrated in the figures, the stand 100 is shown in a particular location relative to the handle, or strap of the golf bag 200, it should be appreciated that the attachment point of the stand 100 may be located at various other positions on the golf bag 200.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A golf bag stand system comprising:

a top bracket for coupling to a top portion of a golf bag;

a pair of legs pivotably coupled to the top bracket;

a guide for coupling to a bottom portion of the golf bag;

a wire form slidably coupled through the guide and engaging the legs, wherein actuation of the wire form moves the legs from a retracted position to an extended position;

a foot plate pivotably mounted to the wire form, the foot plate having a contact point with the ground for actuating the wire form, the contact point being located behind the plane of the legs.

2. The golf bag stand system of claim 1, wherein the dual clip is held in place by a deformity in the wire form.

3. The golf bag stand system of claim 1, wherein each leg of the pair of legs includes a top section having a substantially flat inner surface, the substantially flat inner surfaces configured to be the first contact point between the pair of legs when the pair of legs are moved into the retracted position.

4. The golf bag stand system of claim 1, wherein in the retracted position the pair of legs are located substantially adjacent to the golf bag and are parallel to one another.

5. The golf bag stand system of claim 4, further comprising a bi-planar cut away base.

6. The golf bag stand system of claim 1, wherein a pair of oversized feet are coupled to the pair of legs.

7. A golf bag stand comprising:

a top bracket for coupling to a top portion of a golf bag;

a pair of legs pivotably coupled to the top bracket;

a guide for coupling to a bottom portion of the golf bag;

a wire form slidably coupled through the guide and engaging the legs, wherein actuation of the wire form moves the legs from a retracted position to an extended position; and a double clip coupled to the wire form to keep the pair of legs in tension, the double clip having a top end and a bottom end, the top end providing tensioning in the wire form and the bottom end providing separation in the wire form.

8. The golf bag stand system of claim 7, wherein the double clip is held in place by a deformity in the wire form.

9. The golf bag stand system of claim 8, wherein the deformity in the wire form comprises a portion of the wire form having a cross section with a different shape than surrounding portions of the wire form.

10. The golf bag stand system of claim 7, wherein each leg of the pair of legs includes a top section having an inner surface, the inner surfaces configured to be the first contact point when the pair of legs are moved into the retracted position, whereby the pair of legs are prevented from crossing.

11. The golf bag stand system of claim 7, wherein in the retracted position the pair of legs are parallel to one another.

12. The golf bag stand system of claim 7, further comprising a base having a cut away portion, the cut away portion including two intersecting planes coupled by a radius.

* * * * *

UNITED STATES PATENT AND TRADEMARK OFFICE

CERTIFICATE OF CORRECTION

PATENT NO. : 5,887,833

DATED : March 30, 1999

INVENTOR(S) : Chloe Helen Sundara et al.

It is certified that error appears in the above-identified patent and that said Letters Patent is hereby corrected as shown below:

Column 6, line 13, prior to "a foot plate..." insert the element --a clip to hold the pair of legs in tension, wherein the clip is a dual clip having a top end and a bottom end, the dual clip providing tensioning at the top end and separating at the bottom end; and --

Signed and Sealed this

Twentieth Day of July, 1999

*Attest:*

*Attesting Officer*

Q. TODD DICKINSON

*Acting Commissioner of Patents and Trademarks*